United States Patent [19]

Zückler

[11] Patent Number: 4,618,750

[45] Date of Patent: Oct. 21, 1986

[54] VACUUM SWITCHING TUBE WITH A COIL FOR GENERATING A MAGNETIC FIELD

[75] Inventor: Karl Zückler, Berlin, Fed. Rep. of Germany

[73] Assignee: Siemens Aktiengesellschaft, Berlin and Munich, Fed. Rep. of Germany

[21] Appl. No.: 743,697

[22] Filed: Jun. 11, 1985

[30] Foreign Application Priority Data

Jun. 19, 1984 [DE] Fed. Rep. of Germany ..... 3422949

[51] Int. Cl.[4] ..... H01H 33/66

[52] U.S. Cl. ..... 200/144 B; 200/147 R

[58] Field of Search ..... 200/144 B, 147 R, 147 A

[56] References Cited

U.S. PATENT DOCUMENTS

| | | | |
|---|---|---|---|
| 3,372,259 | 3/1968 | Porter | 200/144 |
| 3,946,179 | 3/1976 | Murano et al. | 200/144 |
| 4,153,827 | 5/1979 | Mircovich et al. | 200/144 B |

FOREIGN PATENT DOCUMENTS

| | | |
|---|---|---|
| 1262407 | 3/1968 | Fed. Rep. of Germany . |
| 2321753 | 11/1973 | Fed. Rep. of Germany . |
| 3033632 | 4/1982 | Fed. Rep. of Germany . |
| 1484018 | 2/1967 | France . |
| 1163271 | 9/1969 | United Kingdom . |

*Primary Examiner*—Robert S. Macon
*Attorney, Agent, or Firm*—Kenyon & Kenyon

[57] ABSTRACT

A vacuum switching tube comprises a stationary contact and a movable contact and a two section coil for generating a magnetic field between the contacts. A first coil section is associated with the stationary contact and generates, together with the movable contact designed as the other coil section, an axial magnetic field which permeates the space between the contacts. Since the predominant part of the magnetic field is generated by the stationary coil, the movable contact can be designed with relatively little mass and loss. The apparatus is suitable for vacuum switching tubes which control equally well large switching currents and large rated currents with a small temperature rise and little drive energy.

5 Claims, 4 Drawing Figures

VACUUM SWITCHING TUBE WITH A COIL FOR GENERATING A MAGNETIC FIELD

BACKGROUND OF THE INVENTION

The present invention relates to a vacuum switching tube having a stationary contact and a contact which is arranged movably relative thereto in a straight line, as well as having a coil carrying the current to be switched, for generating a magnetic field permeating the space between the contacts.

A vacuum switching tube of this type has become known through DE-OS No. 30 33 632. In that switching tube, the coil has the purpose of generating an axially aligned magnetic field, i.e., a magnetic field, the lines of which extend substantially parallel to the longitudinal axis of the contact arrangement. Thus, the field lines extend substantially also parallel to the current filaments of the electric arc discharge occurring between the contacts, whereby a contraction of the arc is prevented in a manner known per se when large currents are switched. If it is desired to control switching currents of 30,000 amperes and more, the required magnetic field can be generated economically only if the coil used for this purpose is arranged in the immediate vicinity of the contacts or is formed by them themselves.

In the vacuum switching tube according to DE-OS No. 30 33 632 mentioned above, the coil generating the magnetic field is associated with the stationary contact. The desired axial field pattern is obtained by providing the contacts with ferromagnetic parts which allow the field lines to pass approximately axially into the space between the contacts.

The existence of the ferromagnetic parts at the movable contact of the vacuum switching tube described above makes it difficult to control a large switching current as well as a large permanent current. Because of the relatively low electric conductivity of the ferromagnetic parts, it is necessary to design the movable contact and its current lead-in bolt with an enlarged cross section in order to keep the temperature rise in continuous operation low, particularly with a permanent current of 3,000 A and more. However, the contact is given thereby a relatively large mass which has an unfavorable influence on the magnitude of the mechanical drive energy during the switching. In addition, the ferromagnetic parts allow a residual magnetic field to remain at the time of the zero crossing of the current, which makes it more difficult to quench the arc.

SUMMARY OF THE INVENTION

It is therefore an object of the present invention to provide a vacuum switching tube of the type mentioned above which works with an axial magnetic field and operates with low loss and a residual magnetic field as small as possible at the current zero crossing and has a low-mass movable contact.

According to the invention, the above and other objects are achieved by the provision that the predominant part of the coil is arranged stationary and the remaining part is arranged at the movable contact. In this manner, it is achieved, without the use of ferromagnetic bodies, that the magnetic field permeates the space between the contacts approximately axially. Although the coil comprises two sections which are connected in series by the arc, it acts substantially like a one-piece coil. Since only a small part of the ampere-turns of the coil need to be accommodated at the movable contact, this contact can be designed in a simple manner with low mass and low loss.

A vacuum switching tube is already known, the field-generating winding of which consists of two coils which can be connected in series by the arc (U.S. Pat. No. 3,372,259, corresponding to French Pat. No. 1,484,018). One coil is arranged stationary and the further coil movably. Both coils are designed equal and similar, i.e., comparable as to number of turns and diameter. This causes a relatively large moving mass and the production of dissipation heat in a region of the vacuum tube from which it cannot be removed easily. Apart from this, this vacuum switching tube has a concentric contact arrangement in which a rotatably supported cylindrical washer-shaped, movable contact engages a stationary ring-shaped contact body. This arrangement is on the one hand advantageous for the behavior of the arc but makes it more difficult to achieve large rated voltages and rated currents.

The stationary and the movable part of the coil can be designed similarly, as is known per se from the design of vacuum switching tubes. In particular, according to the present invention, the stationary part of the coil can be designed as a current lead to the stationary contact and may have a slotted contact plate, the diameter of which corresponds approximately to the average diameter of the coil windings of the stationary coil section. It is assured by the design of the contact plate that a magnetic field of sufficient magnitude is present at the outermost rim of the contact plate. For the desired range of large to very large switching currents, a multi-strand design of the stationary part of the coil is advisable. Thereby, several parallel current paths are produced. By slotting the contact plate, residual magnetic fields can be suppressed in a manner known per se at the time of the current zero crossing, which have an adverse effect on the quenching of the arc.

The remaining part of the coil which must be accommodated at the movable contact can be achieved in a manner known per se by a cup-shaped design of the movable contact, the wall of the contact being slotted at an angle and being covered by a flat contact plate. It is important that the slots be arranged in such a manner that the generated magnetic field extends in the same sense as the magnetic field of the stationary coil part.

It is advisable to fasten the stationary coil section to a terminating flange, designed to carry current, of the housing of the vacuum switching tube. Thereby, the current feed into the stationary coil section, especially in a multi-strand design, as well as good heat removal are assured.

BRIEF DESCRIPTION OF THE DRAWINGS

The invention will be described in greater detail in the following detailed description with reference to the drawings, in which.

DETAILED DESCRIPTION

Figure 2:
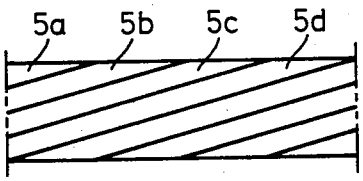
FIG. 2 shows the stationary coil in development form.

With reference now to the drawings, the vacuum switching tube 1 comprises a housing 2 composed of metal parts and ceramic parts. An upper terminating flange 3 supports on the outside a lead bolt 4 provided with threads and a stationary coil section 5 in the interior of the housing 2. This coil section 5 is designed with a large cross section so that a strong magnetic field can be generated with small Joule heat losses. Mechanical strength of the coil corresponding to the stresses is achieved by support bodies 6 arranged between the turns. The coil has several strands, i.e., is designed in the present case with four parallel branches as is illustrated in FIG. 2 by means of a development. The parallel branches are designated in FIG. 2 with *5a, 5b, 5c* and *5d*. The side of the coil section 5 facing away from the terminating flange 3 is connected to a contact 7, the contact plate 8 of which has approximately the mean diameter of the coil turns. This contact plate may comprise a material which is particularly well suited for switching in a vacuum, for instance, a composite material of chromium and copper. Such a material can also be applied to a mechanically stronger carrier plate. In the interior of the coil section 5, a support body which is electrically nonconductive or only poorly so can be arranged for supporting the contact plate 8.

On the side of the housing 2 opposite the terminating flange 3, there is a lower terminating flange 9 by which a movable contact 11 is guided movably by means of a sliding bearing, not specifically shown, as the carrier of a movable contact 11. Spring bellows 19 make possible, in a manner known per se, the motion of the current feed bolt 10 required for switching off and on in the direction of a double arrow 23 and at the same time the sealing of the interior of the switching tube completely relative to the surrounding atmosphere. The movable contact 11 is largely shaped like the known cup contacts. The wall 12 of contact 11 is provided with slots 13 which run at an angle to the contact axis and cause the current to change its flow direction in such a manner that the contact assumes the property of a coil turn. On its side facing the stationary contact plate 7, the movable contact 11 likewise carries a contact plate 14 with a diameter corresponding to the contact plate 7.

Figure 3:
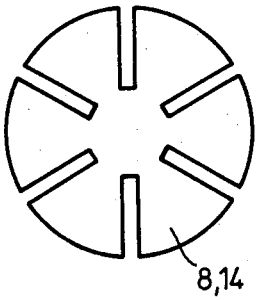
FIGS. 3 and 4 show examples for slotted contact plates.
Figure 4:
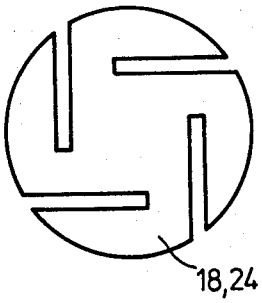

The contact plates 8 and 14 may be slotted for avoiding eddy currents. Such slotting can be arranged in a manner known per se, for instance, radially in accordance with FIG. 3 or in accordance with FIG. 4 (contact plates 18 and 24) in such a manner that the slots begin at the rim of the contact plate and go past a line drawn through the center. These and further examples can be seen in U.S. Pat. No. 3,946,179.

The part of the housing 2 surrounding the contacts is formed by a metal jacket 15 which is followed in the direction toward the upper terminating flange 3 by a hollow ceramic insulator 16 and in the direction toward the lower terminating flange by a further hollow ceramic insulator 17. The connections between all the parts of housing 2 can be formed by soldering in a manner known per se. Shielding rings 20 and 21 are disposed at the transition points between the metal jacket 15 and the hollow insulators 16 and 17 in order to avoid concentrations of the electric field.

Figure 1:
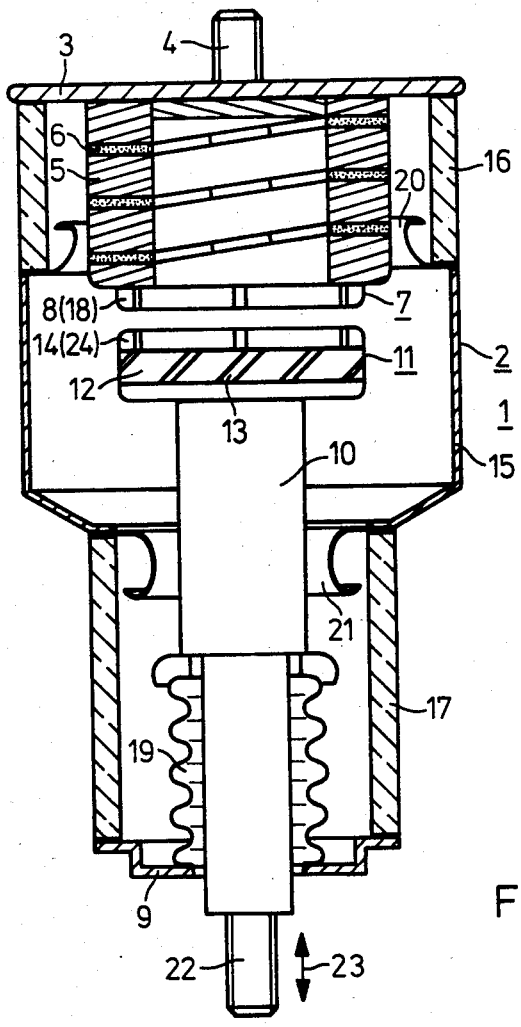
FIG. 1 shows a vacuum switching tube schematically and in cross section.

The operation of the switching tube described is as follows: the "on" state is brought about by an upward movement of the current lead bolt 10 between the upper connecting bolt 4 and the threaded post 22 of the current lead bolt 10. A continuous current path is then formed which comprises the upper terminating flange 3, the coil section 5, the contact plate 8, the contact plate 14, the slotted wall 12 as the movable coil section as well as the current feed bolt 10. The Joule losses occurring in this closed state are kept relatively low by the provision that the coil section 5 is designed with an intentionally large cross section. Since the current path is free of ferromagnetic parts, there are no additional losses. If the "off" state shown in FIG. 1 is brought about by a downward movement of the current feed bolt 10, the opening arc is drawn between the contact plates 8 and 14. The arc is in the region of the magnetic field which extends in the same direction as the longitudinal axis of the contact arrangement and which is generated by the coil section 5 in the same direction as the movable contact 11 acting on it and as the field generated by the movable coil section. Both coil sections are connected in series by the arc so that the field lines change their direction only behind the movable contact 11, as seen from the coil section 5. A cerain amount of stray flux which occurs in the open state of the contacts in the space between them is of minor importance for the effectiveness of the arrangement.

As can be seen readily, the contact and coil arrangement described can be used regardless of any particular form of the housing. The described housing 2 therefore represents only an example which can be modified with respect to the materials indicated as well as to the design. Furthermore, the coil section disposed at the movable contact 11 may be designed differently from what is shown in the illustrated embodiment.

In the foregoing specification the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A vacuum switching tube having a housing, a stationary contact and a movable contact disposed in the housing, said movable contact being movable in a straight line relative to the stationary contact, said switching tube further comprising coil means carrying the current to be switched by the switching tube for generating a magnetic field extending in the space between the contacts, said coil means having two sections, a first and substantially larger section of said coil means being disposed on the stationary contact and the second and smaller section being disposed on the movable contact.

2. The vacuum switching tube recited in claim 1, wherein the stationary section of said coil means comprises a current lead to the stationary contact and said stationary contact has a slotted contact plate, the diameter of the contact plate approximately corresponding to the mean diameter of the stationary coil section.

3. The vacuum switching tube recited in claim 1, wherein the stationary coil section comprises a plurality of conducting strands.

4. The vacuum switching tube recited in claim 1, wherein the movable contact comprises a cup-shaped element having a wall having angled slots and including a flat slotted contact plate forming the remaining part of the second coil section.

5. The vacuum switching tube recited in claim 1, wherein the first coil section is fastened to a current carrying terminating flange of the housing.

* * * * *